US007484481B2

(12) United States Patent
Fujisawa et al.

(10) Patent No.: US 7,484,481 B2
(45) Date of Patent: Feb. 3, 2009

(54) COMBUSTION-TYPE POWER TOOL HAVING SWITCH PROTECTION ARRANGEMENT

(75) Inventors: Haruhisa Fujisawa, Hitachinaka (JP); Yoshitaka Akiba, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/356,208

(22) Filed: Feb. 17, 2006

(65) Prior Publication Data

US 2006/0185630 A1 Aug. 24, 2006

(30) Foreign Application Priority Data

Feb. 18, 2005 (JP) ..... P2005-043278
Jan. 23, 2006 (JP) ..... P2006-014463

(51) Int. Cl.
*F02B 71/04* (2006.01)
*B25C 1/08* (2006.01)
*H01H 3/60* (2006.01)

(52) U.S. Cl. ..... 123/46 SC; 123/46 H; 227/10; 200/301

(58) Field of Classification Search ..... 123/46 SC, 123/46 H, 46 R; 134/10; 227/10, 130; 173/209; 200/573, 302.1, 301, 245, 257
See application file for complete search history.

(56) References Cited

U.S. PATENT DOCUMENTS 3,215,807 A * 11/1965 Spitler ..... 200/298
3,720,188 A * 3/1973 Mead ..... 122/41
4,403,722 A * 9/1983 Nikolich ..... 227/8
4,483,473 A * 11/1984 Wagdy ..... 227/8
4,483,474 A * 11/1984 Nikolich ..... 227/8
4,522,162 A * 6/1985 Nikolich ..... 123/46 SC
4,613,327 A * 9/1986 Tegrarian et al. ..... 604/141
4,981,120 A * 1/1991 Mangum, Jr. ..... 123/149 D
5,191,209 A * 3/1993 Rodseth et al. ..... 250/229
5,558,059 A * 9/1996 Yoshinaga et al. ..... 123/198 E
5,743,969 A * 4/1998 Lawler ..... 134/10
6,082,468 A * 7/2000 Pusateri et al. ..... 173/170
6,547,021 B1 * 4/2003 Kai et al. ..... 180/190
2002/0158102 A1 * 10/2002 Patton et al. ..... 227/8
2003/0034195 A1 * 2/2003 Rioux et al. ..... 180/292
2004/0112309 A1 * 6/2004 Odoni et al. ..... 123/46 SC
2004/0139795 A1 * 7/2004 Kawakubo et al. ..... 73/112
2004/0173657 A1 * 9/2004 Turk ..... 227/10
2004/0182331 A1 * 9/2004 Rosenbaum ..... 123/41.72

(Continued)

FOREIGN PATENT DOCUMENTS

JP 64-009149 1/1989

(Continued)

*Primary Examiner*—Stephen K Cronin
*Assistant Examiner*—Ka Chun Leung
(74) *Attorney, Agent, or Firm*—Antonelli, Terry, Stout & Kraus, LLP.

(57) ABSTRACT

A main switch section is accommodated in a trigger. The trigger provided on the handle through a spring. The handle is formed with a recess to which one end of the spring is seated, so that the trigger is normally urged toward the lower side of the combustion-type nail driver. A switch accommodating portion is provided in the lower side of the canister housing. A push switch is stored in the switch accommodating portion. The push switch is a commodity type micro-switch covered with a switch protection member made from an elastic material such as a rubber.

13 Claims, 7 Drawing Sheets

U.S. PATENT DOCUMENTS

2004/0182335 A1* 9/2004 Keller et al. ..... 123/46 H
2004/0182336 A1* 9/2004 Ohmori et al. ..... 123/46 R
2005/0035171 A1* 2/2005 Ohtsu et al. ..... 227/8
2005/0098123 A1* 5/2005 Miyata et al. ..... 123/46 SC
2005/0252945 A1* 11/2005 Odoni et al. ..... 227/10
2006/0006207 A1* 1/2006 Akiba et al. ..... 227/10
2006/0043141 A1* 3/2006 Panasik et al. ..... 227/10
2006/0249106 A1* 11/2006 Heinzen ..... 123/46 H
2006/0261122 A1* 11/2006 Moeller et al. ..... 227/10

FOREIGN PATENT DOCUMENTS

JP 64-034753 2/1989
JP 03-025307 2/1991
JP 04-011337 1/1992
JP 04-048589 2/1992
JP 2720248 11/1997

* cited by examiner

COMBUSTION-TYPE POWER TOOL HAVING SWITCH PROTECTION ARRANGEMENT

BACKGROUND OF THE INVENTION

The present invention relates to a combustion-type power tool, and more particularly, to such power tool capable of driving a fastener of driving such as a nail, an anchor, and a staple into a workpiece by igniting a mixture of air and gaseous fuel, which in turn causes a linear momentum of a piston.

U.S Pat. Nos. 4,483,474, 4,403,722, 4,522,162, 4,483,473, and 5,191,209 disclose a combustion type power tool in which motive power of a piston is generated upon ignition of air-fuel mixture to drive a fastener such as a nail and a rivet into a workpiece.

The power tool generally includes a housing frame, a head cover, a combustion chamber frame, a cylinder, a piston, a driver and blade. The head cover is positioned at one end of the housing frame. The combustion chamber frame is reciprocally movable and abuttable on the head cover. The cylinder is disposed in the housing frame. The piston is reciprocally movable within the cylinder. The driver blade is attached to the piston to drive the fastener by the movement of the piston. A sealed combustion chamber is defined by the head cover, combustion chamber frame, cylinder, and piston when the combustion chamber frame is in abutment with the head cover. A gas canister accumulating therein a combustible fuel is provided in the housing frame. An ignition plug is provided to generate a spark for igniting air-fuel mixture when the fuel is injected and vaporized in the combustion chamber. Upon explosive combustion, the piston is rapidly moved to move the driver blade so that the fastener is driven into the workpiece.

SUMMARY OF THE INVENTION

In the conventional combustion type nail gun described in the publications, a switch having a mechanical junction or contact is used. A remarkably large impact force is imparted on the nail gun body at a time of nail driving operation such as not less than about 1000 G. On the other hand, a commercially available mechanical switch such as a micro-switch provides a tolerance against impact of about 100 G.

It is therefore an object of the present invention to provide a combustion type power tool capable of using a commodity type switch such as a micro-switch to reduce a cost despite of the application of excessive impact force to the tool body due to fastener driving operation or the like.

This and other object of the present invention will be attained by a combustion-type power tool including a housing, a cylinder head, a cylinder, a piston, a combustion chamber frame, an elastic member, and a switch.

The housing has one end and another end. The handle is provided on the housing. The cylinder head is disposed at the one end of the housing. The cylinder is disposed in and fixed to the housing. The cylinder defines an axial direction. The cylinder has one end positioned at the one end side of the housing and another end positioned at the another end side of the housing. The piston is slidably disposed in the cylinder and reciprocally movable in the axial direction. The combustion chamber frame is disposed in the housing and movable in the axial direction. The combustion chamber frame is abuttable on the cylinder head to provide a combustion chamber in cooperation with the cylinder head and the piston. The elastic member is provided on one of the housing and the handle. The switch is provided on one of the housing and the handle through the elastic member. The switch has one end portion facing to the one end side of the housing. The elastic member covers the one end portion.

In another aspect of the invention, there is provided a combustion type power tool including a housing, a cylinder head, a cylinder, a piston, a combustion chamber frame, an resilient member, and a trigger.

The housing has one end and another end. The cylinder head is disposed at the one end of the housing. The cylinder is disposed in and fixed to the housing. The cylinder defines an axial direction. The cylinder having one end positioned at the one end side of the housing and another end positioned at the another end side of the housing. The piston is slidably disposed in the cylinder and reciprocally movable in the axial direction. The combustion chamber frame is disposed in the housing and movable in the axial direction. The combustion chamber frame is abuttable on the cylinder head to provide a combustion chamber in cooperation with the cylinder head and the piston. The resilient member attached to the handle. The trigger is provided on the handle through the resilient member.

DETAILED DESCRIPTION OF THE PREFERRED EMBODIMENTS

A combustion-type power tool according to an embodiment of the invention will be described with reference to FIGS. 1 through 7. The embodiment pertains to a combustion-type nail driver. In the following description, the terms "upper", "lower", "above", "below", "upward", "downward" and the like will be used assuming that the combustion-type nail driver is disposed in an orientation in which a nail is fired vertically downward.

Figure 1:
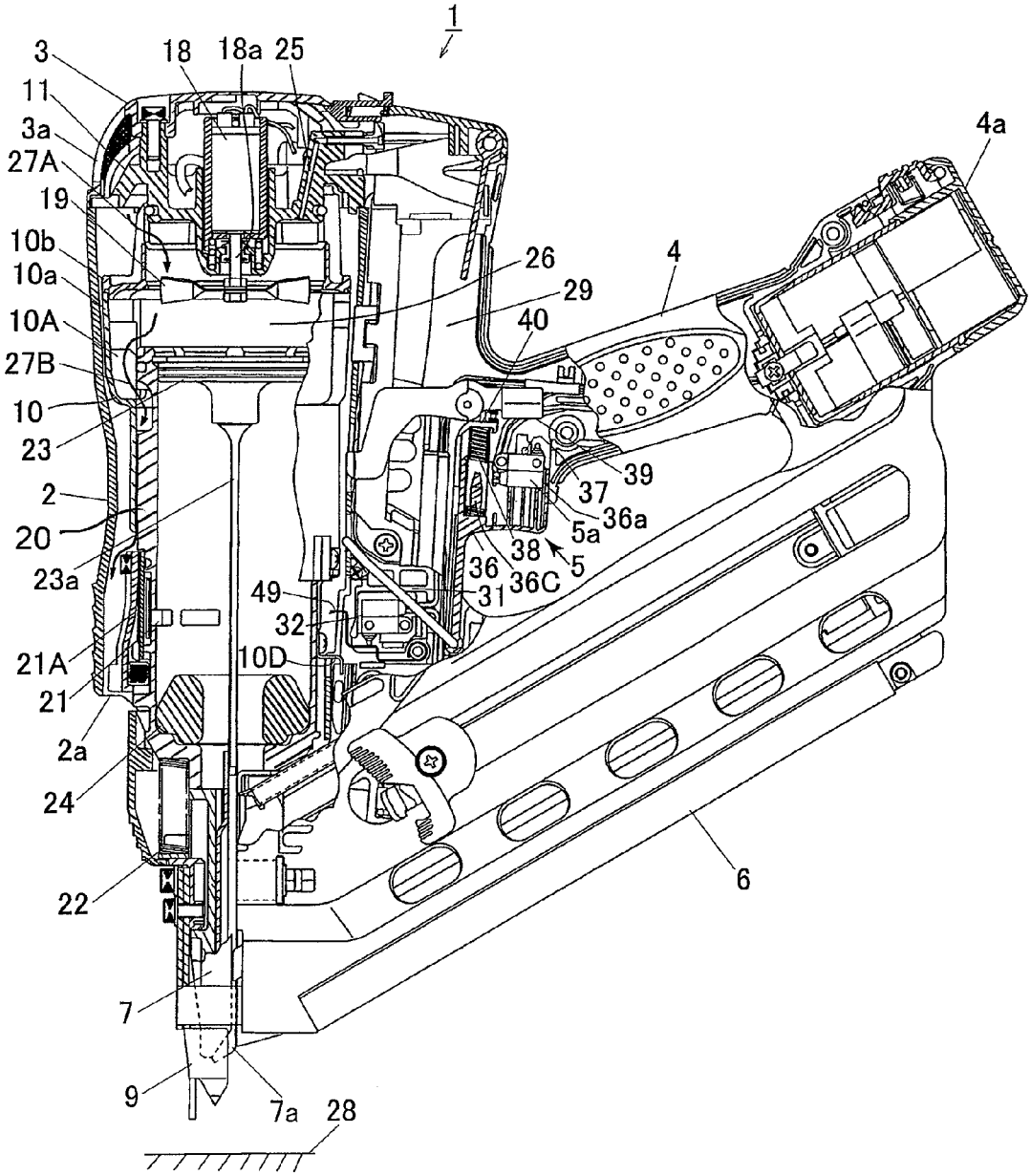
FIG. 1 is a schematic side view partly cross-sectioned showing a combustion-type power tool according to a first embodiment of the present invention and shows an initial state prior to fastener driving operation.

The combustion-type nail driver 1 shown in FIG. 1 has a housing 2 constituting an outer frame. A head cover 3 formed with an intake port 3*a* is mounted on the top of the housing 2. A handle 4 extends from one side of the housing 2. The handle 4 detachably accommodates therein a battery pack 4*a* and a grip portion provided with a trigger switch 5 that commands a start of the nail driving. The trigger switch 5 includes a main switch section 5*a*, a trigger 36 to be manipulated by an operator, a pin 37, a spring 38, and a trigger arm 39. The pin 37 holds the main switch section 5*a* within an interior of the trigger 36. The spring 38 urges the trigger 36 toward the lower side of the combustion-type nail driver 1. The trigger arm 39 is attached to the upper portion of the trigger 36.

Figure 2A:
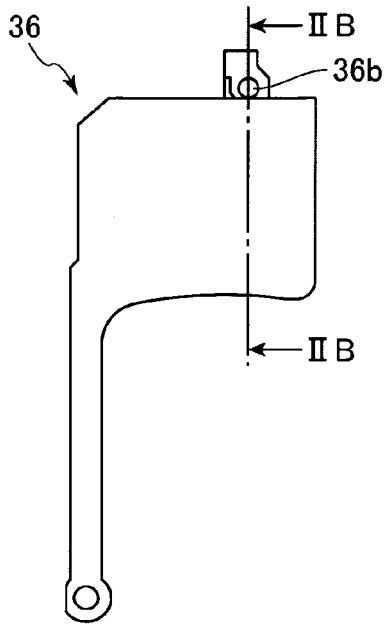
FIG. 2A is a schematic diagram showing a trigger of the combustion-type power tool according to the first embodiment of the present invention.
Figure 2B:
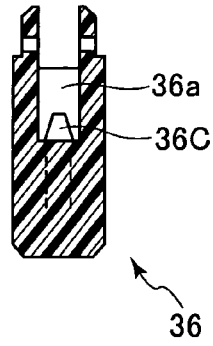
FIG. 2B is a cross-sectional view of the trigger taken along a line IIB-IIB in FIG. 2A.

The trigger 36 is in an inverted L shape and made from a plastic material as shown in FIG. 2A. An inside of the trigger 36 has a trigger switch accommodating portion 36*a* for accommodating therein the main switch section 5*a*, and a spring holding portion 36*b* as shown in FIG. 2B. The main switch section 5*a* is a commodity type micro-switch, and is retained in the trigger 36 by the pin 37 extending through a hole 36*b* formed at an end portion of the trigger 36. The spring 38 is also retained in the trigger 36 by the spring holding portion 36C. On the other hand, the handle 4 is formed with a recess 40 to which one end of the spring 38 is seated, so that the trigger 36 is normally urged toward the lower side of the combustion-type nail driver 1.

The combustion-type nail driver 1 also has a canister housing 29 at one side of the housing 2 from which the handle 4 extends. A gas canister 30 (see FIG. 4) containing therein a combustible liquidized gas is detachably installable in the canister housing 29. A magazine 6 accommodating therein a bundle of nails (not shown) is disposed below the handle 4.

A nose 7 extends from near the lower end of the housing 2. The nose 7 is integral with a cylinder 20 described later and has a tip end abuttable on a workpiece 28. The nose 7 is adapted for guiding sliding movement of a driver blade 23*a* described later and for guiding the nail driven into the workpiece 28. A push lever 9 is reciprocally slidingly movably supported to the nose 7, and projects from the tip end 7*a* of the nose 7.

Figure 3:
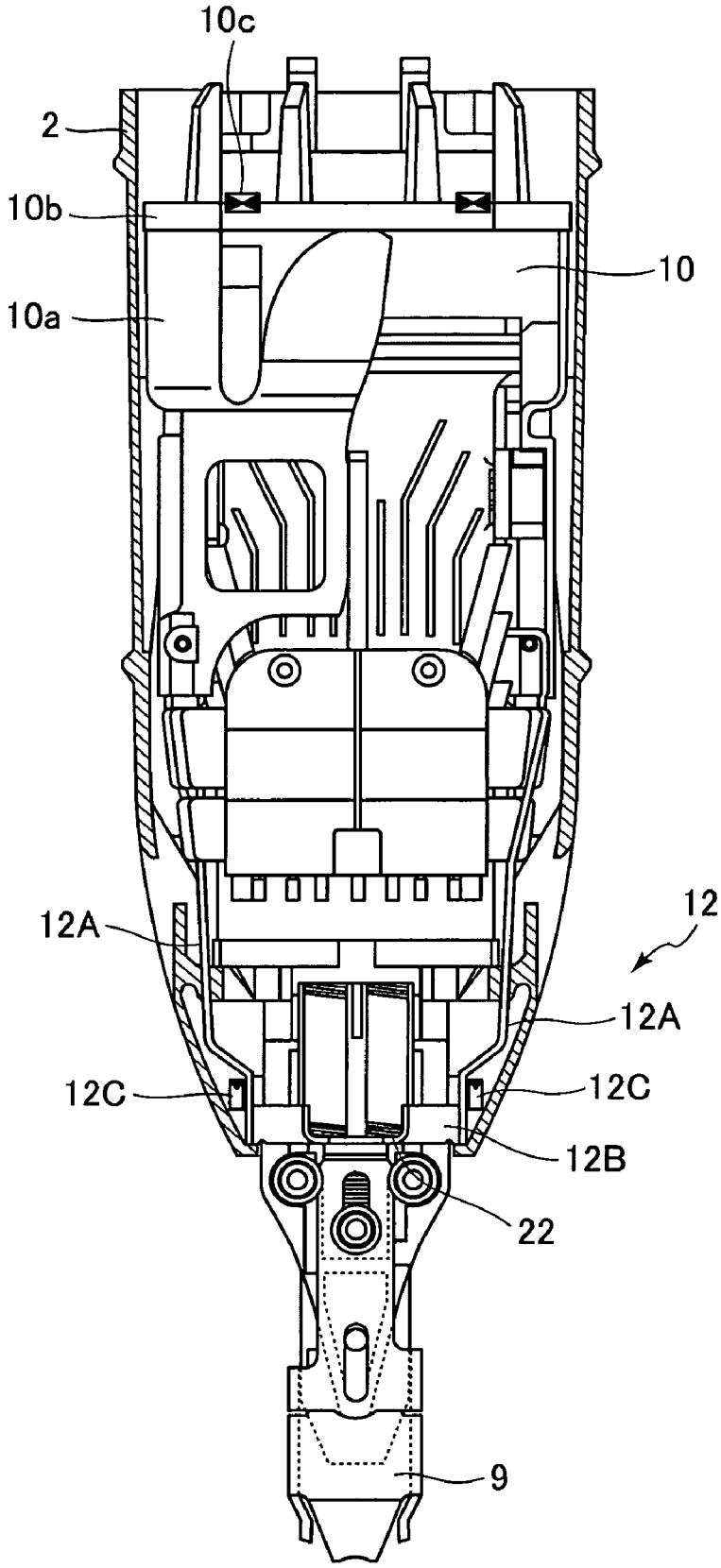
FIG. 3 is a schematic side view partly cross-sectioned showing a combustion-type power tool as viewed from the left side in FIG. 1.

As shown in FIG. 3, the push lever 9 has an upper end in association with or abuttable on a connection unit 12 fixed to a combustion-chamber frame 10 described later. The connection unit 12 includes a pair of arm sections 12A each having stepwise bending portions, and a connector section 12B having a generally rectangular shape. Each upper end of each arm section 12A is bent into L-shape and fixed to the combustion-chamber frame 10. Each lower end of each arm section 12A is fixed to the connector section 12B by means of screws 12C. The connector section 12B has major sides each provided with an upstanding piece at each end portion of the major side. Each upstanding piece is formed with a thread hole with which each screw 12C is threadingly engageable. Each upstanding piece is bent at an angle of substantially 90 degrees at each major side, so that two bent upstanding pieces are in confronting relation to each other. The connector section 12B has a flat area beside the upstanding pieces. The flat area serves as a spring seat.

A compression coil spring 22 is interposed between the connector section 12B and the cylinder 20 for normally urging the push lever 9 in a protruding direction from the housing 2. When the housing 2 is pressed toward a workpiece 28 while the push lever 9 is in abutment with the workpiece against a biasing force of the compression coil spring 22, an upper portion of the push lever 9 is retractable into the housing 2.

A cylinder head 11 is fixedly secured to the top of the housing 2 and substantially covers the open top end of the housing 2. A motor 18 is disposed at one side of the cylinder head 11 opposite the combustion chamber 26 as will be described later. An ignition plug (not shown) is disposed in the vicinity of the motor 18 and the ignition position is directed toward the combustion chamber 26.

The cylinder head 11 has a handle side in which is formed a fuel ejection passage 25 which allows a combustible gas to pass therethrough. One end of the ejection passage 25 opens at the lower surface of the cylinder head 11. Another end of the ejection passage 25 serves as a gas canister connecting portion 25*a* in communication with a gas canister 30.

The combustion-chamber frame 10 is provided in the housing 2 and is movable in the lengthwise direction of the housing 2. The uppermost end of the combustion-chamber frame 10 is abuttable on the lower surface of the cylinder head 11. The combustion-chamber frame includes a base chamber frame 10*a* and a chamber head 10*b* connected integrally using a bolt 10*c* (see FIG. 3). Since the arm section 12A is connected to the combustion-chamber frame 10, the combustion-chamber frame 10 is moved in accordance with the movement of the push lever 9. A first plate 10D is fixed to an outer peripheral surface of the combustion-chamber frame 10.

The cylinder 20 is fixed to the housing 2. An outer peripheral surface of the cylinder 20 is in sliding contact with the inner circumference of the combustion-chamber frame 10 for guiding the movement of the combustion-chamber frame 10. The cylinder 20 has an axially intermediate portion formed with an exhaust hole 21. An exhaust-gas check valve 21A is provided to selectively close the exhaust hole 21.

A piston 23 is slidably and reciprocally movably provided in the cylinder 20. The piston 23 divides an inner space of the cylinder 20 into an upper space above the piston 23 and a lower space below the piston 23. The driver blade 23*a* extends downwards from the lower surface of the piston 23 to the nose 7, so that the tip end of the driver blade 23*a* can strike against the nail (not shown). A bumper 24 made from an elastic material such as rubber is disposed at a lower side of the cylinder 20. The piston 23 strikes against the bumper 24 when the piston 23 is moved downward toward a bottom dead center.

Figure 4:
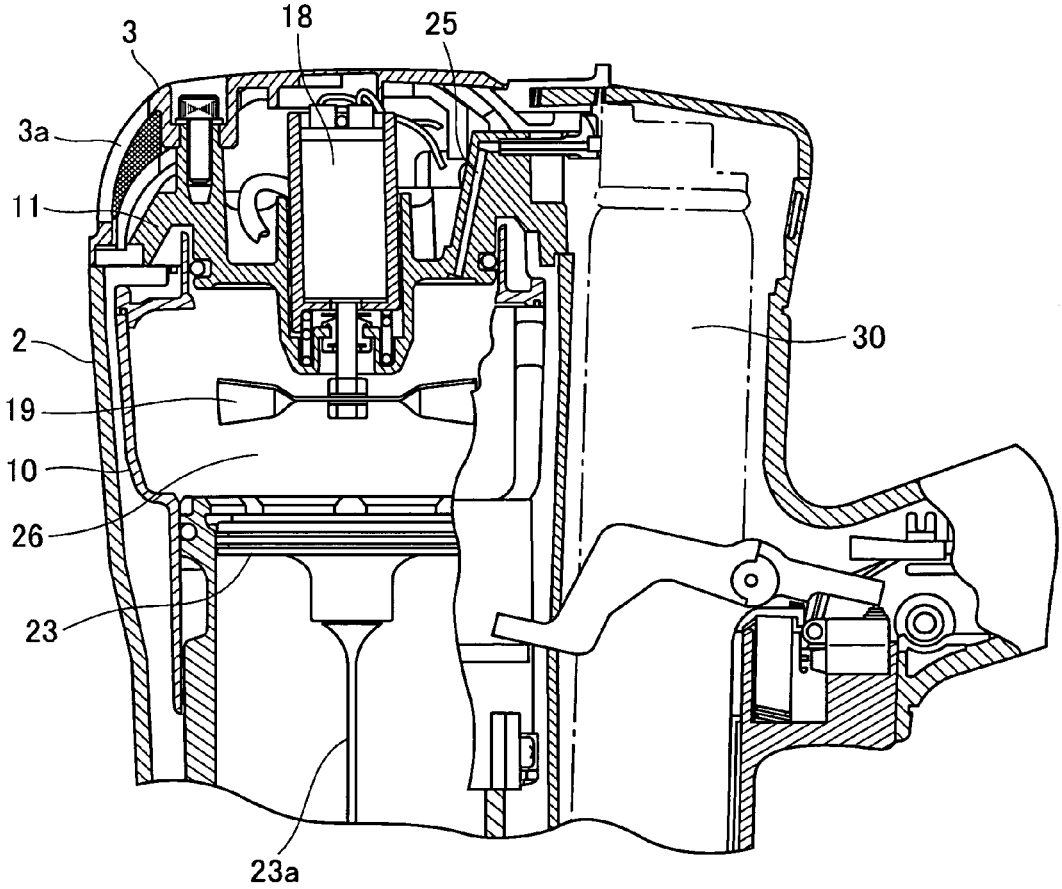
FIG. 4 is a partial enlarged diagram showing the vicinity of the combustion chamber of the combustion-type power tool and shows a state where a sealed combustion chamber is provided in the fastener driving operation.

When the upper end of the combustion-chamber frame 10 abuts the cylinder head 11, the cylinder head 11, the combustion-chamber frame 10, and the upper cylinder space above the piston 23 define a combustion chamber 26 (see FIG. 4). When the combustion-chamber frame 10 is separated from the cylinder head 11, a first flow passage 27A in communication with the atmosphere is provided between the cylinder head 11 and the upper end of the combustion-chamber frame 10, and a second flow passage 27B in communication with the first flow passage 27A is provided between the inner peripheral surface of the combustion-chamber frame 10 and the outer peripheral surface of the cylinder 20.

The housing 2 has a lower portion formed with an exhaust port 2*a*. The first and second flow passages 27A and 27B allow a combustion gas and a fresh air to pass along the outer peripheral surface of the cylinder 20 for discharging these gases through the exhaust port 2*a* of the housing 2. Further, the above-described intake port 3*a* is formed for supplying a fresh air into the combustion chamber 26, and the exhaust hole 21 discharges combustion gas generated in the combustion chamber 26.

The motor 13 has a fan shaft 18A, and a fan 19 positioned in the combustion chamber 23 is fixed to a tip end of the fan shaft 13A. Rotation of the fan 19 performs the following three functions. First, the fan 19 stirs and mixes the air with the combustible gas as long as the combustion-chamber frame 10 remains in abutment with the cylinder head 11. Second, after the mixed gas has been ignited, the fan 19 causes turbulence of the air-fuel mixture, thus promoting the turbulent combustion of the air-fuel mixture in the combustion chamber 26. Third, the fan 19 performs scavenging such that the exhaust gas in the combustion chamber 26 can be scavenged therefrom and also performs cooling of the cylinder 20 when the combustion-chamber frame 10 moves away from the cylinder head 11 and when the first and second flow passages 27A and 27B are provided.

A plurality of ribs 10A protrudes radially inwardly from the portion of the combustion chamber frame 10, the portion defining the combustion chamber 26. Each rib 10A extends in the axial direction of the combustion chamber frame 10. The ribs 10A promote stirring and mixing of the air and the combustible gas in the combustion chamber 26 in cooperation with the fan 18.

Figure 5:
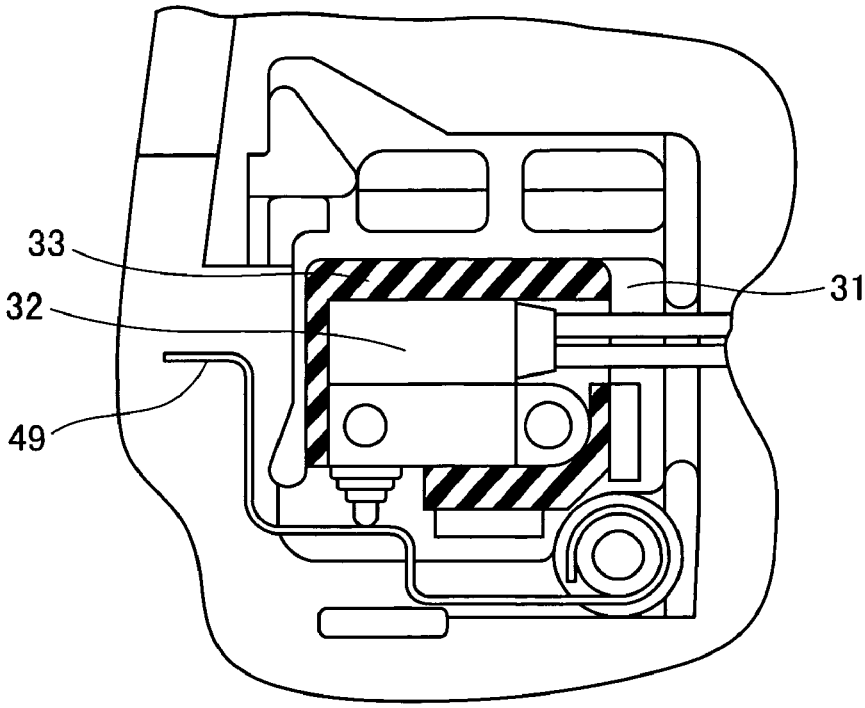
FIG. 5 is a partial enlarged diagram showing the vicinity of a push switch of a combustion-type power tool according to a first embodiment of the present invention.

A switch accommodating portion 31 is provided in the lower side of the canister housing 29. A push switch 32 is stored in the switch accommodating portion 31. The push switch 32 is a commodity type micro-switch covered with a switch protection member 33 made from an elastic material such as a rubber as shown in FIGS. 5 and 6. A second plate 49 is provided to the switch accommodating portion 31. A part of the second plate 49 is in contact with the push switch 32. The push switch 32 can be turned ON when the first plate 10D fixed to the combustion-chamber frame 10 pushes up the second plate 49 as a result of elevating the combustion-chamber frame 10 by depressing of the push lever 9 against the workpiece. Then, the push switch 32 provides a command signal indicative of driving the motor 18. Thus, the motor 18 starts to rotate, thereby staring rotation of the fan 19.

Figure 6A:
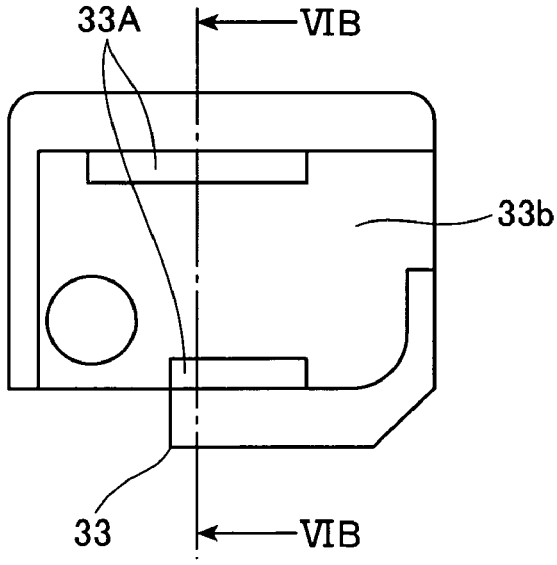
FIG. 6A is a schematic diagram showing a switch protection member of the combustion-type power tool according to the first embodiment of the present invention.
Figure 6B:
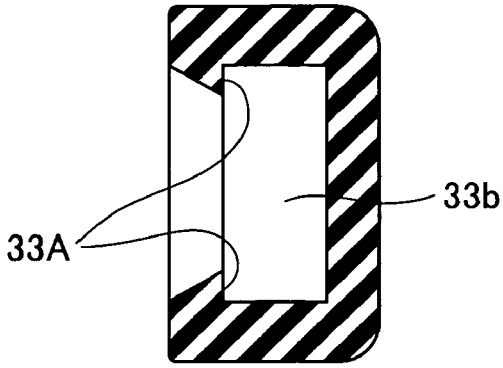
FIG. 6B is a cross-sectional view of the switch protection member taken along a line VIB-VIB in FIG. 6A.

As shown in FIGS. 6A and 6B, the switch protection member 33 has pawls 33A at an open insertion side of a switch accommodation space 33*b* so as to prevent the push switch 32 from being released from the accommodation space 33*b* after the latter is set therein.

The switch accommodation portion 31 of the handle 4 has a wall whose surface is in conformance with the configuration of the switch protection member 33.

Figure 7:
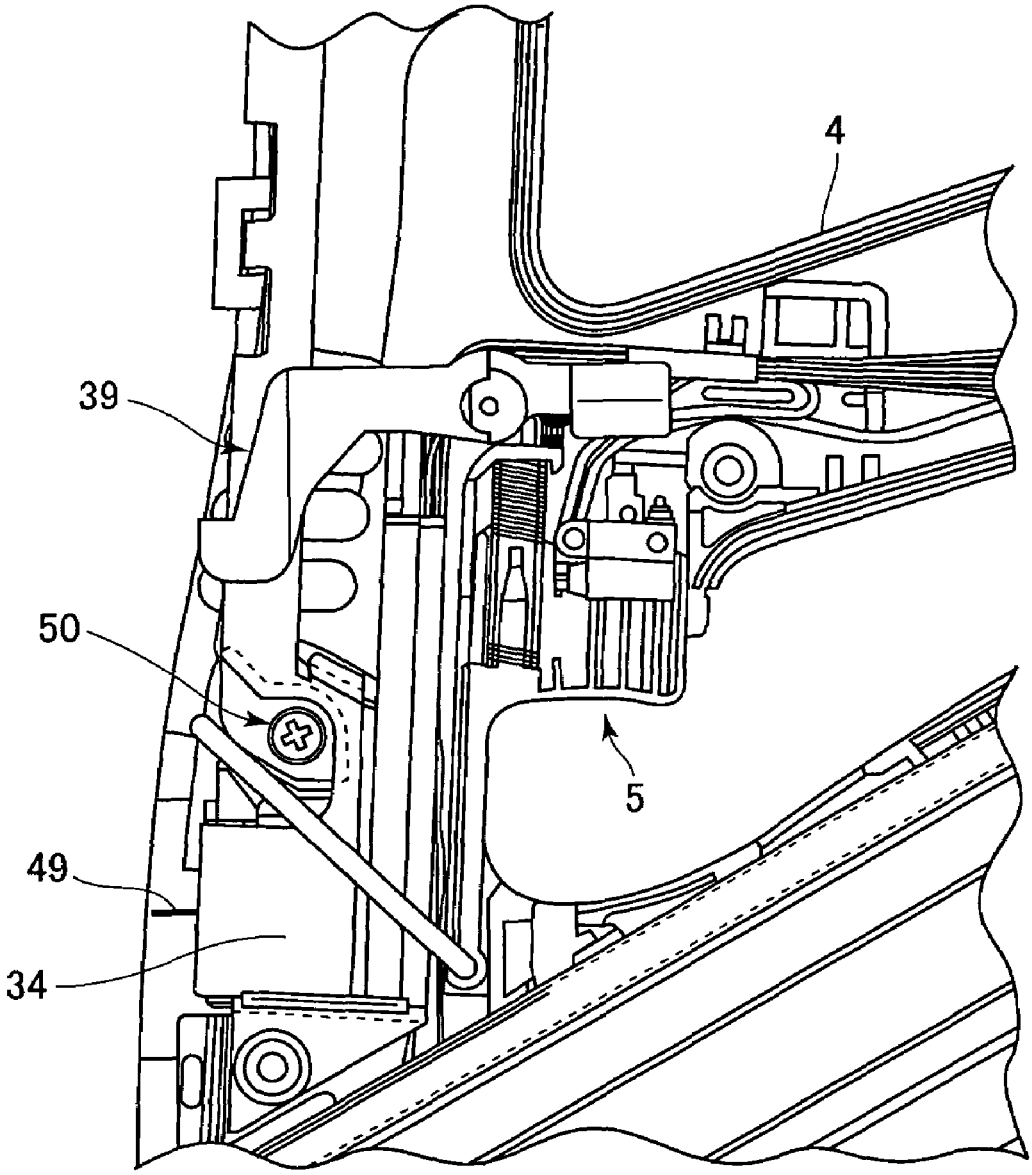
FIG. 7 is a schematic diagram showing an internal arrangement of the canister accommodation portion prior to the assembly of the cover according to a first embodiment of the present invention.
Figure 8:
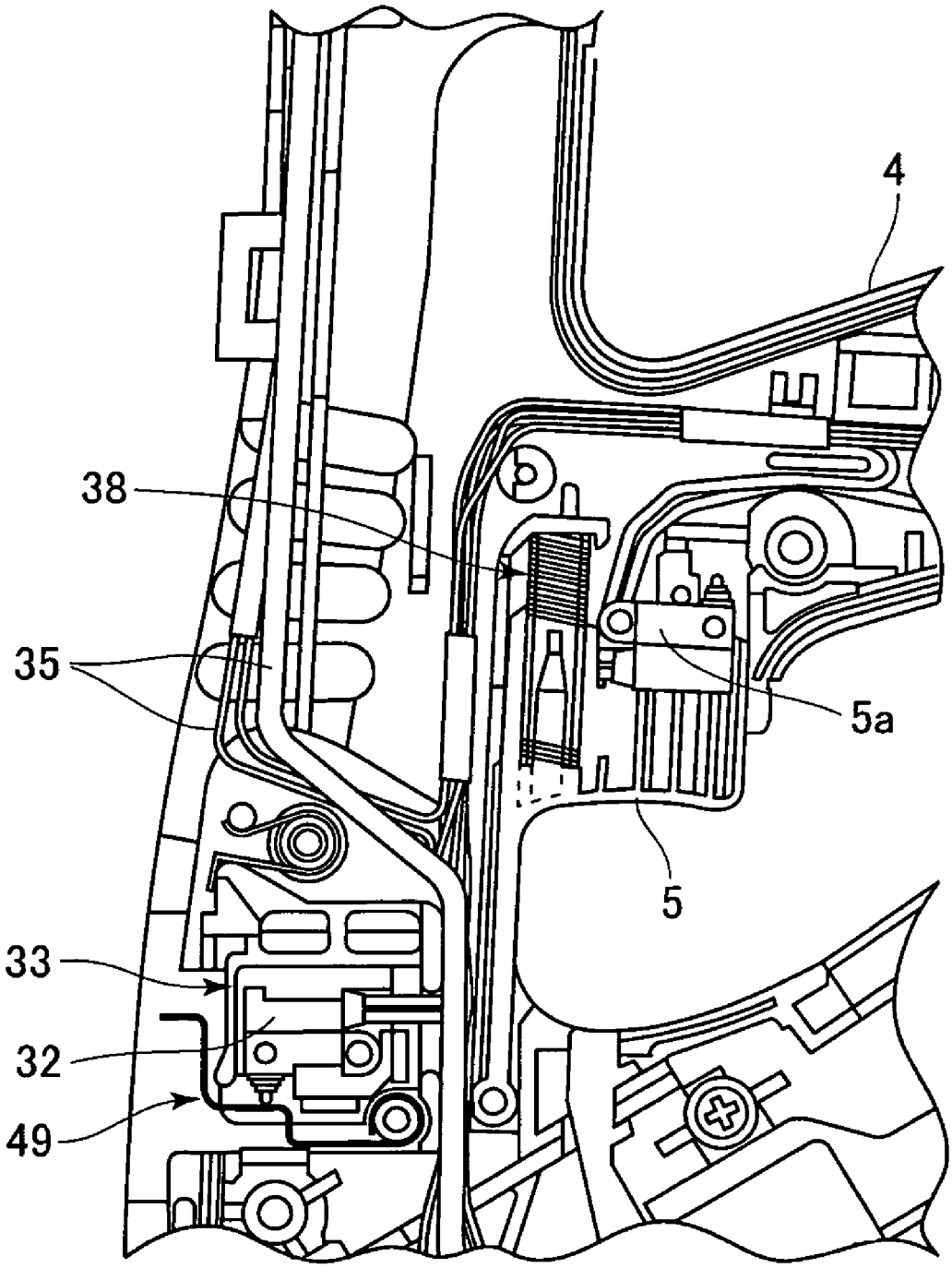
FIG. 8 is a schematic diagram showing a state an ignition arrangement in a combustion-type power tool according to a second embodiment of the present invention.

As shown in FIG. 7, a cover 34 is covered over the switch accommodating portion 31, and is fixed to the handle 4 by a screw 50. Instead of the screw 50, the cover 34 can also be fixed to the handle 4 by a resilient locking engagement between the cover and a locking groove formed in the handle 4. FIG. 8 shows an internal arrangement of the canister accommodation portion 31 prior to the assembly of the cover 34, and FIG. 7 shows the state after assembly of the cover 34. An internal electric wire 35 extends through the canister accommodation portion 4*a*.

Next, operation of the combustion-type power tool 1 will be described. In the non-operational state of the combustion-type nail driver 1, the push lever 9 is biased downward by the biasing force of the compression coil spring 22, so that the push lever 9 protrudes from the lower end of the nose 7. Thus, the uppermost end of the combustion-chamber frame 10 is spaced away from the cylinder head 11 because the combustion-chamber frame 10 is in association with the push lever 9 through the arm section 12A. Further, a part of the combustion-chamber frame 10 which part defines the combustion chamber 26 is also spaced apart from the top portion of the cylinder 20. Hence, the first and second flow passages 27A and 27B are provided. In this condition, the piston 23 stays at the top dead center in the cylinder 20.

With this state, if the push lever 9 is pushed onto the workpiece 28 while holding the handle 4 by a user, the push lever 9 is moved upward against the biasing force of the compression coil spring 22. At the same time, the combustion-chamber frame 10 which is connected to the push lever 9 through the connection unit 12 is also moved upward, as shown in FIG. 3, closing the first flow passage 27A and hermetically sealing the combustion chamber 26.

In accordance with the movement of the push lever 9, the gas canister 30 is tilted toward the cylinder head 11. Thus, the injection rod 30*a* of the gas canister 30 is pressed against a gas canister connecting portion 25*a* of the cylinder head 11. Therefore, the liquidized combustible gas in the gas canister 30 is ejected once from the ejection port of the fuel ejection passage 25 into the combustion chamber 26.

Further, in accordance with the movement of the push lever 9, the first plate 10D fixed to the combustion-chamber frame 10 pushes up the second plate 49 whereupon the switch 32 is turned ON to supply electric power to the motor 18 and start rotation of the fan 19. Rotation of the fan 19 in the combustion chamber 26 in which a hermetically sealed space is provided, stirs and mixes the ejected combustible gas with air in the combustion chamber 26.

In this state, when the trigger switch 5 provided at the handle 4 is turned ON, spark is generated at the ignition plug 50 to ignite the combustible gas. As a result of combustion, volumetric expansion of the combustion gas occurs within the combustion chamber 26 to move the piston 23 downwardly. Accordingly, the driver blade 23*a* drives the nail held in the nose 7 into the workpiece 28 until the piston 23 strikes against the bumper 24.

After the nail driving, the piston 23 strikes against the bumper 24, and the combustion gas is discharged out of the cylinder 20 through the exhaust hole 21 of the cylinder 20. When the inner space of the cylinder 20 and the combustion chamber 26 becomes the atmospheric pressure, the exhaust-gas check valve 21A is closed. Combustion gas still remaining in the cylinder 20 and the combustion chamber 26 has a high temperature at a phase immediately after the combustion. The heat is absorbed through the inner surfaces of the cylinder 20 and the combustion-chamber frame 10, and the temperature of these components is also increased. However, the absorbed heat is released to the atmosphere through the outer surfaces of the cylinder 20 and the combustion-chamber frame 10.

Combustion heat of the combustion gas is absorbed into such components as the cylinder 20, so that the combustion gas is abruptly cooled down and a volume of the combustion gas is decreased. Thus, the pressure in the sealed space in the cylinder 20 above the piston 23 further drops to less than the atmospheric pressure, creating a so-called "thermal vacuum". Accordingly, the piston 23 is moved back to the initial top dead center position.

Thereafter, the trigger switch 5 is turned OFF, and the user lifts the nail driver 1 until the push lever 9 is separated from the workpiece 28. As a result, the push lever 9 and the combustion-chamber frame 10 move downward due to the biasing force of the compression coil spring 22. In this case, the fan 19 keeps rotating for a predetermined period of time in spite of OFF state of the trigger switch 5 because of an operation of a control portion (not shown). In the state shown in FIG. 1, the first and second flow passages are provided at the upper side of the combustion-chamber frame 10, so that fresh air flows into the combustion chamber 26 through the intake port 3*a* formed in the head cover 3 and the residual gas is expelled through the exhaust port 2*a* by the rotation of the fan 19. Thus, the combustion chamber 26 is scavenged. Then, the rotation of the fan 19 is stopped to restore an initial stationary state. Thereafter, subsequent nail driving operation can be performed by repeating the above described operation process.

As described above, since the main switch section 5*a* of the trigger switch 5 is attached to the handle 4 through the resilient member such as the spring 38, transmission of the impact force at the time of faster driving operation to the main switch section 5*a* can be moderated by the spring 38. Since the switch protection member 33 has pawls 33A, the push switch 32 can be positioned stably in switch protection member 33. Further, the cover 34 can prevent the switch protection member 31 from being disassembled from the handle 4 after the switch protection member 33 protecting the push switch 32 is installed in the handle 4. The cover 34 also serves to cover and protect the wire 35.

Since, the push switch 32 is covered with the switch protection member 33, transmission of the impact force about 10 times as large as the tolerance against impact at the time of faster driving operation to the push switch 32 can be moderated by the switch protection member 33. Accordingly, this construction prevents the push switch 32 from break down by the impact force damaging to the mechanical junction of the push switch 32 and the impact force causing chattering to cause frictional wearing in the junction. Since it is not necessary to use a photoelectric switch for reducing the mechanical junction of the combustion-type nail driver 1, production cost of the combustion-type nail driver 1 can be reduced.

Figure 9:
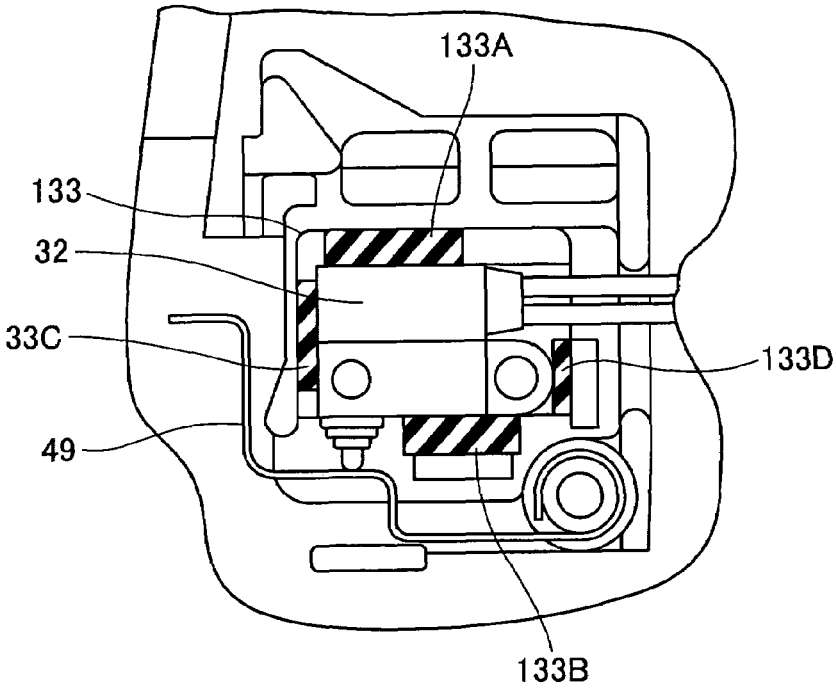
FIG. 9 is a partial enlarged diagram showing the vicinity of a push switch of a combustion-type power tool according to a second embodiment of the present invention.

A combustion type power tool according to a second embodiment of the present invention will be described with reference to FIG. 9. The second embodiment pertains to a protective arrangement for a push switch 32. In the first embodiment, the switch protection member 33 is an integral piece for covering almost all outer surface of the push switch 32. On the other hand, in the second embodiment, a switch protection member 133 is segmented into a plurality of segments 133A, 133B, 133C and 133D, each segment covering each surface of the push switch 32. The reason is as follows.

Impact force imparted on the tool body depends on the condition of using the tool. However, generally, the largest impact is applied when the piston 23 strikes against the bumper 24, and the second largest impact is applied when the combustible gas is ignited and exploded. A force directing upward, i.e., directing to the head cover 3 is applied to the push switch 32 when the piston 23 strikes the bumper 24, and a force directing downward, i.e., directing to the nose 7 is applied to the push switch 32 at the time of ignition and explosion. Therefore, the switch protecting member must at least includes the upper segment 133A in order to protect the push switch 32 against the large impact force. This protection can be improved by providing the lower segment 133B. Further, the left segment 133Cc and the right segment 133D can prevent the push switch 30 from is accidental displacement due to impact.

Figure 10:
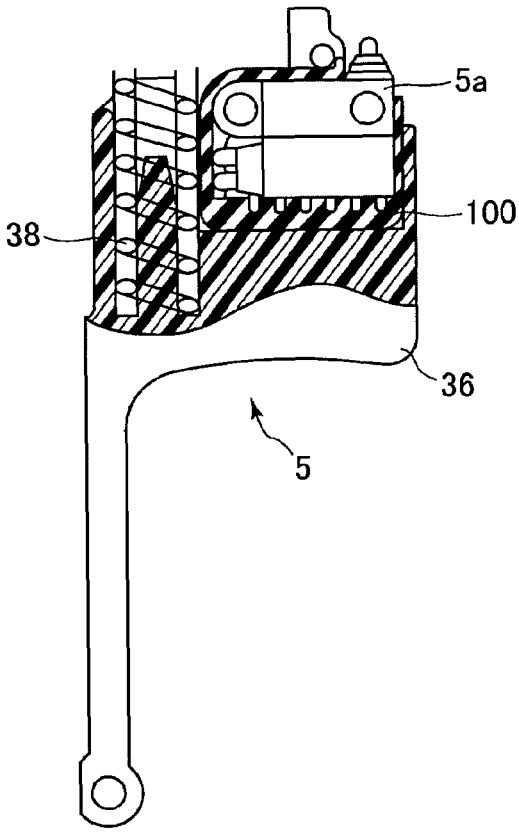
FIG. 10 is a schematic diagram showing a trigger switch of the combustion-type power tool according to a third embodiment of the present invention.

FIG. 10 shows an arrangement for protecting a main switch section 5*a* of the trigger switch in a combustion type power tool according to a third embodiment of the present invention. In the third embodiment, the main switch section 5*a* is attached to the trigger 36 through a main switch protection member 100 made from an elastic material such as a rubber. The main switch protection member 100 is positioned to surround the main switch section 5*a*. With this arrangement an impact force applied to the trigger switch 5 can further be reduced to prolong service life thereof. As a modification, a segmented protection member can be provided only at an upper face and a lower face of the main switch section 5*a*, i.e., at the position to cross the reciprocating direction of the piston 23.

What is claimed is:

1. A combustion-type power tool comprising:

a housing having one end side and another end side;

a handle provided on the housing;

a cylinder head disposed at the one end side of the housing;

a cylinder disposed in and fixed to the housing, the cylinder defining an axial direction, the cylinder having one end positioned at the one end side of the housing and another end positioned at the another end side of the housing;

a piston slidably disposed in the cylinder and reciprocally movable in the axial direction;

a combustion chamber frame disposed in the housing and movable in the axial direction, the combustion chamber frame being abuttable on the cylinder head to provide a combustion chamber in cooperation with the cylinder head and the piston;

an elastic member provided in one of the housing and the handle; and a switch provided in one of the housing and the handle through the elastic member, the switch having one end portion facing to the one end side of the housing, and having another end portion facing to the another end side of the housing;

wherein the elastic member comprises a pair of elastic segments, one of the pair of elastic segments covering the one end portion of the switch and an other of the pair of elastic segment covering the another end portion of the switch.

2. The combustion-type power tool according to claim 1, further comprising a nose provided on the another end of the cylinder, the nose extending in a protruding direction away from the cylinder;

a push lever disposed at the another end side of the housing and movable along the nose in the axial direction upon pressing against a workpiece;

a connecting unit connecting the combustion chamber frame with the push lever; and a motor disposed at the cylinder head.

3. The combustion-type power tool according to claim 2, wherein the switch detects a predetermined position of the combustion chamber frame when the push lever is pressed against a workpiece, the switch providing a command signal indicative of driving the motor.

4. The combustion-type power tool according to claim 1, wherein the elastic member is configured so as to moderate an impact force on the switch during operation of the combustion-type power tool.

5. The combustion-type power tool according to claim 1, wherein the switch controls normal operation of the combustion-type power tool in response to activation of the switch by a user of the combustion-type power tool, the switch and the elastic member being provided in the housing of the combustion-type power tool.

6. A combustion-type power tool comprising:

a housing having one end side and another end side;

a handle provided on the housing;

a cylinder head disposed at the one end side of the housing;

a cylinder disposed in and fixed to the housing, the cylinder defining an axial direction, the cylinder having one end positioned at the one end side of the housing and another end positioned at the another end side of the housing;

a piston slidably disposed in the cylinder and reciprocally movable in the axial direction;

a combustion chamber frame disposed in the housing and movable in the axial direction, the combustion chamber frame being abuttable on the cylinder head to provide a combustion chamber in cooperation with the cylinder head and the piston;

a resilient member attached to the handle;

a trigger provided on the handle and coupled by the resilient member to the handle;

an elastic member provided on the trigger; and a main switch provided on the trigger through the elastic member, the main switch having one end portion facing to the one end side of the housing, the elastic member covering at least the one end portion of the main switch.

7. The combustion-type power tool according to claim 6, further comprising a handle provided on the housing;

a nose provided on the another end of the cylinder, the nose extending in a protruding direction away from the cylinder;

a push lever disposed at the another end side of the housing and movable along the nose in the axial direction upon pressing against a workpiece;

a connecting unit connecting the combustion chamber frame with the push lever; and an ignition plug exposed to the combustion chamber, the ignition plug igniting a mixture of air and the fuel in the combustion chamber;

wherein the cylinder head is formed with a fuel injection passage through which the fuel is flowed.

8. The combustion-type power tool according to claim 7, wherein the main switch provides a command signal indicative of generating a spark to the ignition plug for igniting a mixture of air and the fuel.

9. The combustion-type power tool according to claim 6, wherein the resilient member is configured so as to moderate an impact force on the main switch during operation of the combustion-type power tool.

10. The combustion-type power tool according to claim 6, wherein the elastic member is configured so as to moderate an impact force on the main switch during operation of the combustion-type power tool.

11. The combustion-type power tool according to claim 6, wherein the main switch controls normal operation of the combustion-type power tool in response to activation of the main switch by a user of the combustion-type power tool, the main switch and the elastic member being provided in the handle of the combustion-type power tool.

12. The combustion-type power tool according to claim 6, wherein the resilient member includes a spring.

13. The combustion-type power tool comprising:

a housing having one end side and another end side;

a handle provided on the housing;

a cylinder head disposed at the one end side of the housing;

a cylinder disposed in and fixed to the housing, the cylinder defining an axial direction, the cylinder having one end positioned at the one end side of the housing and another end positioned at the another end side of the housing;

a piston slidably disposed in the cylinder and reciprocally movable in the axial direction;

a combustion chamber frame disposed in the housing and movable in the axial direction, the combustion chamber frame being abuttable on the cylinder head to provide a combustion chamber in cooperation with the cylinder head and the piston;

a resilient member attached to the handle;

a trigger provided on the handle through the resilient member;

an elastic member provided on the trigger; and a main switch provided on the trigger through the elastic member, the main switch having one end portion facing to the one end side of the housing, the elastic member covering at least the one end portion of the main switch;

wherein the main switch has another end portion facing to the another end side of the housing; and wherein the elastic member comprises a pair of elastic segments, one of the pair of elastic segments covering the one end portion of the main switch and an other of the elastic segment covering the another end portion of the main switch.

* * * * *